United States Patent [19]

Huntley

[11] 3,944,200

[45] Mar. 16, 1976

[54] WORKPIECE CLAMPING AND POSITIONING APPARATUS

[76] Inventor: James R. Huntley, 309 W. Crowell St., Monroe, N.C. 28110

[22] Filed: Oct. 2, 1974

[21] Appl. No.: 511,211

[52] U.S. Cl. ..... 269/42; 269/90; 269/218; 269/233; 269/254 R

[51] Int. Cl.[2] ..... B25B 1/20

[58] Field of Search ..... 269/42, 44, 104, 107, 161, 269/233, 41, 254 R, 218, 90

[56] References Cited

UNITED STATES PATENTS

| | | | |
|---|---|---|---|
| 171,899 | 1/1876 | Williams | 269/42 |
| 207,295 | 8/1878 | Moser | 269/42 |
| 212,552 | 2/1879 | Harrison | 269/42 |
| 238,881 | 3/1881 | Forsaith et al. | 269/107 X |
| 817,906 | 4/1906 | Dunne | 269/41 |
| 842,555 | 1/1907 | Johnson | 269/161 |
| 978,187 | 12/1910 | Miller | 269/41 |
| 1,034,482 | 8/1942 | Miller | 269/43 |
| 1,393,059 | 10/1921 | White | 269/42 X |
| 2,761,476 | 9/1956 | Gunas | 269/37 |
| 2,850,931 | 9/1958 | Conway | 269/233 X |
| 3,530,272 | 9/1970 | Roper | 228/44 X |
| 3,682,467 | 8/1972 | Heinrich | 269/88 |

FOREIGN PATENTS OR APPLICATIONS

| | | | |
|---|---|---|---|
| 878,779 | 6/1953 | Germany | 269/42 |
| 2,030,157 | 1/1971 | Germany | 269/107 |
| 31,108 | 12/1907 | Austria | 269/42 |

*Primary Examiner*—Al Lawrence Smith
*Assistant Examiner*—Robert C. Watson
*Attorney, Agent, or Firm*—Parrott, Bell, Seltzer, Park & Gibson

[57] ABSTRACT

Clamping apparatus for quickly and accurately positioning and maintaining a pair of workpieces, such as mitered end picture frame moldings or the like, in desired, generally end-to-end, angularly related positions and being characterized by evenly and resiliently applying clamping forces and positioning forces to the pair of workpieces regardless of slight variations in width of the workpieces, as follows. Backstops receive the outer longitudinal side edges of each of the workpieces and are mounted in angularly related positions corresponding to the desired positions of the workpieces. A slide block is positioned for linear movement along an axis bisecting the angle formed by the workpieces when positioned against the backstops and carries a pair of separate gripper members in side-by-side relation for engaging the workpieces during forward movement for clamping the workpieces against the backstops and for independent movement toward each other upon engagement with the inside edges of the workpieces for sliding the workpieces toward each other for a tight end-to-end abutment for positioning the workpieces. Resilient members separately bias and cushion the gripper members against the opposing movement toward each other for insuring substantially equal and even applications of the clamping and positioning forces by the gripper members to the respective workpieces regardless of slight variations in width thereof.

15 Claims, 12 Drawing Figures

WORKPIECE CLAMPING AND POSITIONING APPARATUS

BACKGROUND OF INVENTION

This invention relates to clamping apparatus for quickly an accurately positioning and maintaining a pair of longitudinally extending workpieces, such a mitered end picture frame moldings or the like, in desired, generally end-to-end, angularly related positions and is characterized by evenly and resiliently applying clamping forces and positioning forces to the pair of workpieces regardless of slight variations in width of the workpieces.

In the building of picture frames and in other operations involving the securement of two longitudinally extending members together in generally end-to-end, angularly related positions, there is a need for a device or mechanism for clamping and holding the workpieces in the desired end-to-end angularly related positions for securing the workpieces together by nails, screws, glue or other means. Heretofore, there have been proposed various jigs, devices, clamps, vices, etc. for holding the picture frame moldings or other workpieces in desired end-to-end, angularly related positions for such securement.

However, all of these previously proposed devices have been deficient in their construction and operation (1) by failing to provide a construction for properly positioning the workpieces by sliding the workpieces into a tight end-to-end abutting relation during the clamping action of the devices for obtaining a better securement of the picture frame moldings or other workpieces together and/or (2) by failing to provide a construction of such clamping device which will compensate for slight variations in the widths of the picture frame moldings or other workpieces during the positioning and clamping thereof. These failures have resulted in inadequate clamping mechanisms which fail to provide the builder of picture frames or other products with a mechanism which will ensure a tight and satisfactory securement of the picture frame moldings or other work-pieces together in the desired, angularly related, end-to-end, abutting relation.

SUMMARY OF THE INVENTION

Accordingly, it is the object of this invention to provide a clamping apparatus for a pair of longitudinally extending workpieces, such as mitered end picture frame moldings or the like, which will quickly and accurately position and maintain the pair or workpieces in desired, generally end-to-end angularly related positions by evenly and resiliently applying clamping forces and positioning forces to the pair of workpieces regardless of slight variations in width of the workpieces.

By this invention, it has been found that the above object may be accomplished by providing a clamping device broadly, as follows. Backstop means are provided for receiving the outside longitudinal side edges of each of the workpieces and are mounted in fixed, desired, angularly related positions corresponding to the desired angularly related positions of the workpieces. Slide block means are mounted and positioned for linear movement along an axis bisecting the angle formed by the workpieces when positioned against the backstop means and toward and away from the inside longitudinal side edges of the workpieces. A pair of separate gripper means is carried by the slide block means in side-by-side relation and extending forwardly thereof for simultaneous, longitudinal, linear movement therewith toward and away from the workpieces and the backstop means for engaging the inside longitudinal edges of the workpieces during forward movement for clamping the workpieces against the backstop means and for independent, generally transverse movement toward each other upon engagement with the inside edges of the workpieces during forward movement thereof for sliding the workpieces toward each other for a tight end-to-end abutment for positioning the workpieces. Resilient means are provided for separately biasing and cushioning the gripper means against the opposing transverse movements toward each other for insuring substantial equal and even applications of the clamping and positioning forces by the gripper means to the respective workpieces regardless of slight variations in width thereof.

In a preferred embodiment according to this invention, means are provided for mounting the gripper means on the slide block means comprising pin means secured to each of the gripper means and extending outwardly therefrom, and generally rounded slot means formed in the sliding block means and being of greater dimensions than the pin means for reception of respective ones of the pin means for carrying the gripper means with the sliding block means and for allowing independent transverse movement of the gripper means toward and away from each other and relative to the sliding block means by movement of the pin means within the slot means. The biasing and cushioning means for the gripper means normally bias the gripper means into positions in which the pin means are positioned in the outermost portions of the generally circular slot means for camming the pin means slightly forwardly and toward each other along the surfaces of the slot means against the bias of the biasing and cushioning means upon engagement of the gripper means with the workpieces and upon further forward movement of the slide block means for like movements of the gripper means for insuring a substantially equal and even application of the clamping and positioning forces by the gripper means on the workpieces regardless of slight variations in width of the workpieces.

Further specific details of the preferred embodiment of apparatus in accordance with this invention will be set forth in the detailed description to follow.

BRIEF DESCRIPTION OF THE DRAWINGS

Some of the objects and advantages of this invention having been set forth, other objects and advantages will appear as the description proceeds, when taken in conjunction with the accompanying drawings, in which.

DESCRIPTION OF PREFERRED EMBODIMENT

Figure 1:
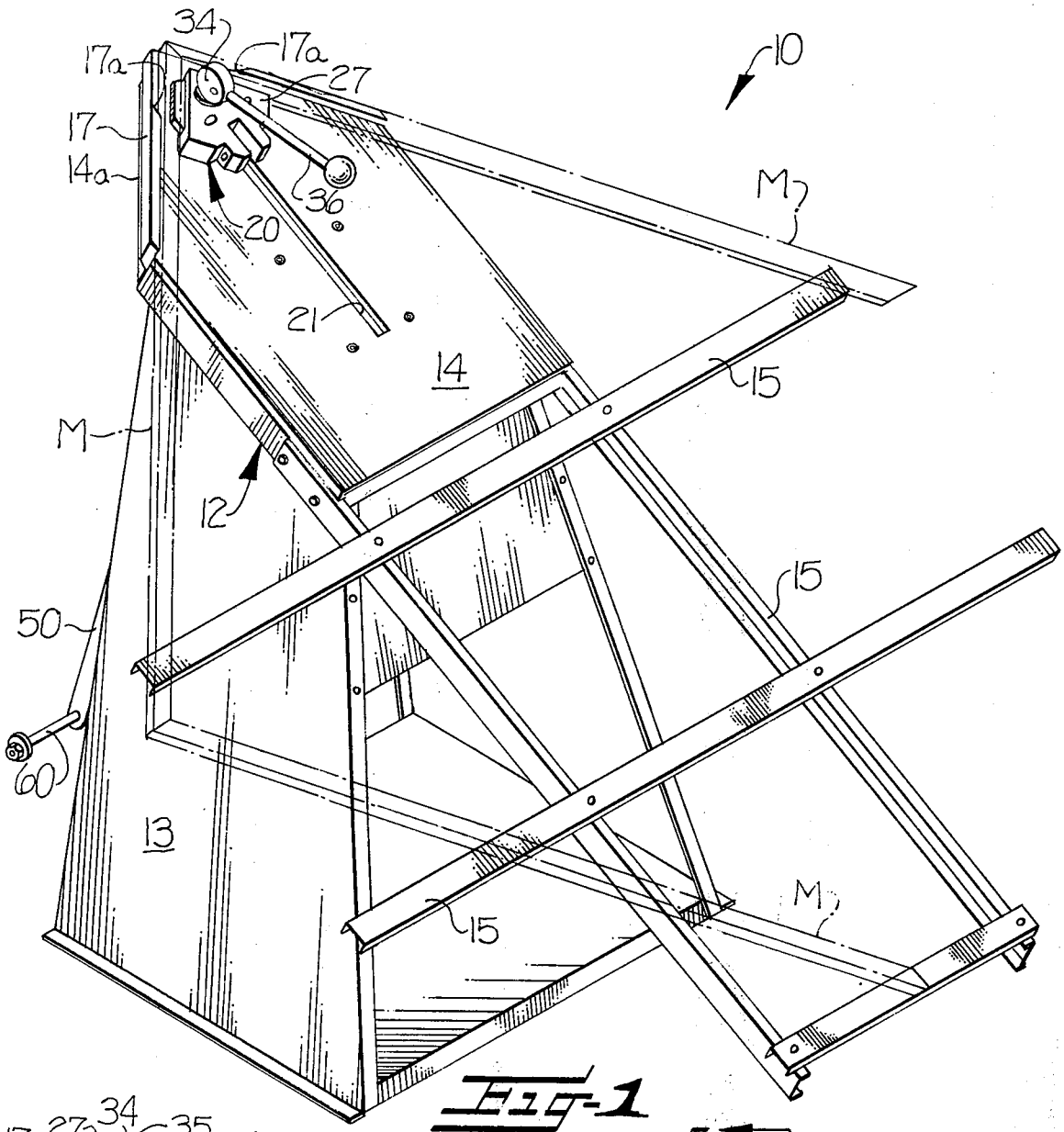
FIG. 1 is a perspective view of the clamping apparatus of this invention.

Referring now to the drawings, there is shown therein a preferred embodiment of a clamping apparatus, generally indicated at 10, in accordance with this invention for quickly and accurately positioning and maintaining a pair of mitered end picture frame moldings M in desired end-to-end angularly related positions for being fastened together to form picture frames.

However, it is to be understood that the clamping apparatus 10 of this invention may be utilized for positioning and clamping workpieces other than picture frame moldings which may have cut ends other than a 45 degree miter and which are desired to be positioned and clamped in generally end-to-end angularly related positions which may be 90 degress or any other desired angularly related positions for being fastened together for any desired purpose. Also, the apparatus 10 of this invention would operate for positioning and clamping workpieces which do not have cut ends and in which the end-to-end relationship would include an outer transverse end of one workpiece and an inner longitudinal end of the other workpiece. However, for ease in description, the clamping apparatus 10 of this invention is illustrated in the drawings and will be described hereinafter with respect to an apparatus for positioning and clamping picture frame moldings which have 45° mitered ends in desired end-to-end angularly related positions of 90° for forming conventional square or rectangular picture frames.

The clamping apparatus 10 includes a work table means, generally indicated at 12, for receiving the bottom surfaces of the mitered end picture frame moldings M to be secured together in end-to-end, angularly related positions. This work table means 12 comprises a generally vertically extending base portion 13 for supporting the clamping apparatus 10 at a convenient working height from a floor and collectively includes bottom and side frame members extending upwardly from the floor. The work table means further includes a table top portion 14 which is mounted on and carried by the base portion 13 and positioned at an upwardly extending angle with respect to a horizontal plane, as shown clearly in FIGS. 1 and 2, for providing an upwardly extending upper surface on the table top portion 14 for receiving and supporting the picture frame moldings M. The upper side edges **14*a* and 14*b* of the table top portion 14** are disposed at approximately a 90° angle with respect to each other so that the picture frame moldings M may be positioned therealong at the same angle for clamping and positioning as will be described below.

Figure 2:
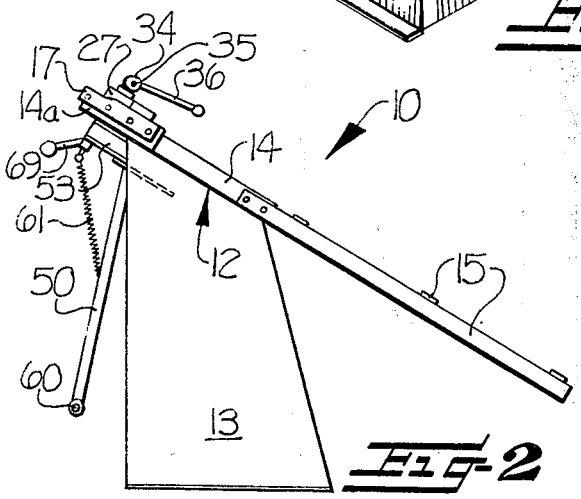
FIG. 2 is a reduced, side, elevational view of the clamping apparatus of FIG. 1.
Figure 3:
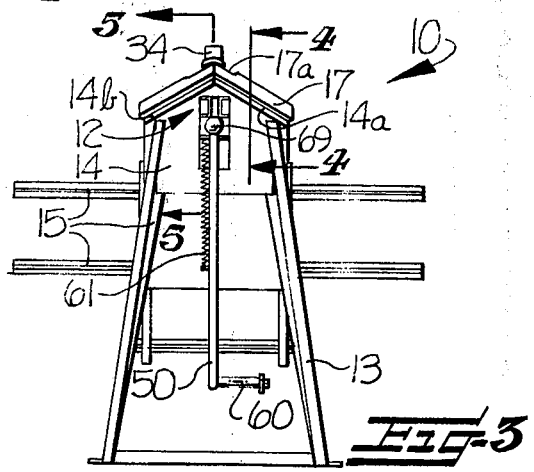
FIG. 3 is a reduced, front, elevational view of the clamping apparatus of FIG. 1.

Thus, the angular, upwardly extending relation of the table top portion 14 and the angularly related, upper, side edges **14*a* and 14*b* allow positioning of the pair of picture frame moldings M at upwardly converging, desired positions for easily being worked on by an operator. The work table means may further include extending frame portions, collectively indicated at 15, which are secured to and extend from the lower edges of the table top portion 14, as shown in FIG. 1**, for supporting the rearwardly extending portions of long picture frame moldings M and portions of the picture frame being built which have already been secured together.

The clamping apparatus 10 further includes backstop means 17 carried by the work table 12 receiving the outside longitudinal side edges of each of the picture frame moldings M and mounted in fixed, desired, angularly related positions corresponding to the desired, angularly related positions of the moldings M. The backstop means 17 generally comprise elongate flange members secured to, extending upwardly from and along the angularly related, upper, side edges **14*a*, 14*b* of the table top portion 14. The backstops 17 include cut outs 17a in the sections thereof adjacent the vertex of the angle formed thereby for allowing access to the abutting ends of the picture frame moldings M positioned thereagainst for securing the moldings together by nails, screws, etc. Thus, the backstops 17** are preferably positioned at a 90° angle with respect to each other for properly positioning the picture frame moldings M thereagainst in their desired 90° angular relationship.

The clamping apparatus 10 further includes a composite slide block, generally indicated at 20, mounted on the work table 12 in a slot 21 through the table top portion 14 for linear movement therealong and along an axis bisecting the angle formed by the picture frame moldings M when positioned against the backstops 17 and toward and away from the inside longitudinal side edges of the moldings M. The composite slide block 20 carries a pair of gripper members 22 in spaced apart, side-by-side relationship which extend forwardly of the slide block 20 for simultaneous, longitudinal, linear movement with the slide block 20 toward and away from the picture frame moldings M and the backstops 17 for engaging the longitudinal inside edges of the respective moldings M during foward movement of the slide block 20 for clamping the moldings M against the backstops 17. The gripper members 22 are also mounted on the slide block 20 for independent, generally transverse movements toward each other upon engagement with the inside edges of the moldings M during forward movement thereof for sliding the moldings M toward each other for a tight end-to-end abutment of the mitered ends of the moldings M for positioning of the moldings M for securement to each other.

Figure 7:
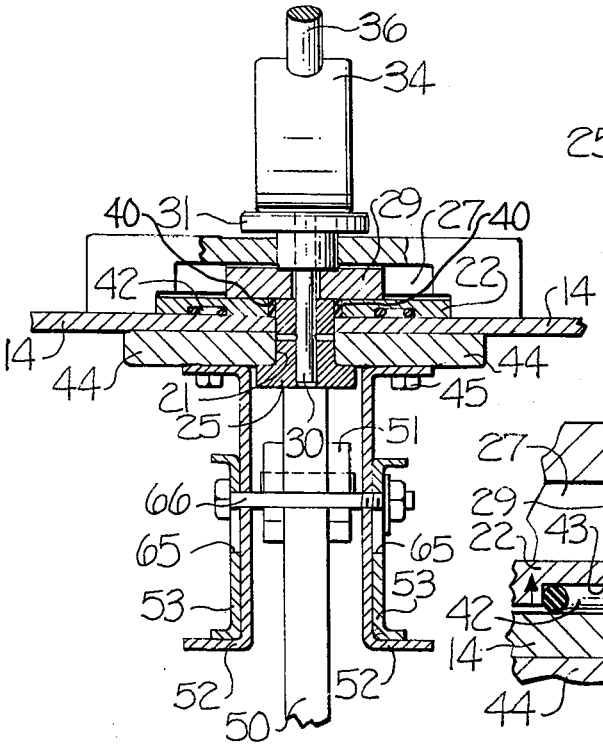
FIG. 7 is a cross-sectional view, taken substantially along the line 7—7 of FIG. 4.

The composite sliding block 20 comprises a solid, center member 25 of generally inverted T-shape in cross-section which defines a solid medial portion of the composite slide block 20. This center member 25 is positioned within the slot 21, as may be clearly seen in FIG. 7, so as to allow sliding movement of the composite sliding block 20 along the slot 21.

The composite sliding block 20 further includes a top, generally arrowhead shape, cover plate member 27 which is positioned generally on top of the center member 25 and provides spaced-apart voids on each side of the center member 25 under the cover plate member 27 for reception of the respective gripper members 22. The top cover plate member 27 defines a transversely extending opening 27*a* on the bottom surface thereof, as may be seen in the exploded view of FIG. 10, for the reception of a locking plate 29, for purposes to be described below. The members 25, 27, 29 are held together by a threaded bolt 30 secured to the center member 24 and extending upwardly through suitable openings in the members 27 and 29.

The upper end of the threaded bolt 30 passes through a circular collar 31 which includes a lower portion passing through an aperture 27b in member 27 to bear against locking plate 29. The upper threaded end of bolt 30 is threadingly received in and secured to a block member 33 to which an eccentric member 34 is pivotally mounted by pin 35. The eccentric member 34 includes a handle 36 extending therefrom. The purpose of the eccentric member 34 and locking plate 29 will be described further below.

The gripper members 22 each comprise a generally flat member positioned within the respective voids formed on each side of the center portion 25 and below the top cover member 27 of the composite slide block 20. The gripper members 22 have portions thereof extending forwardly of the composite slide block 20 and include picture frame molding engaging surfaces 222*a* on the forwardly extending portions which are angularly related with respect to each other corresponding generally to the angular relation of 90° of the backstops 17 and the picture frame moldings M positioned thereagainst. These picture frame molding engaging surfaces 22*a* on the gripper members 22 preferably include roughened edges in the form of serrations or the like therealong for providing a gripping surface for applying the clamping and positioning forces by the gripper means to the workpieces.

The gripper members 22 are mounted on the composite slide block 20 by means of integral pins 37 extending upwardly and outwardly therefrom and generally rounded slots 38 formed in the composite slide block 20 and in the top cover plate member 27 thereof. The slots 38 are of generally greater dimensions than the pins 37 for purposes to be described below and may be of any generally rounded or circular shape including eliptical, etc. for obtaining the desired movements, discussed below.

Figure 6:
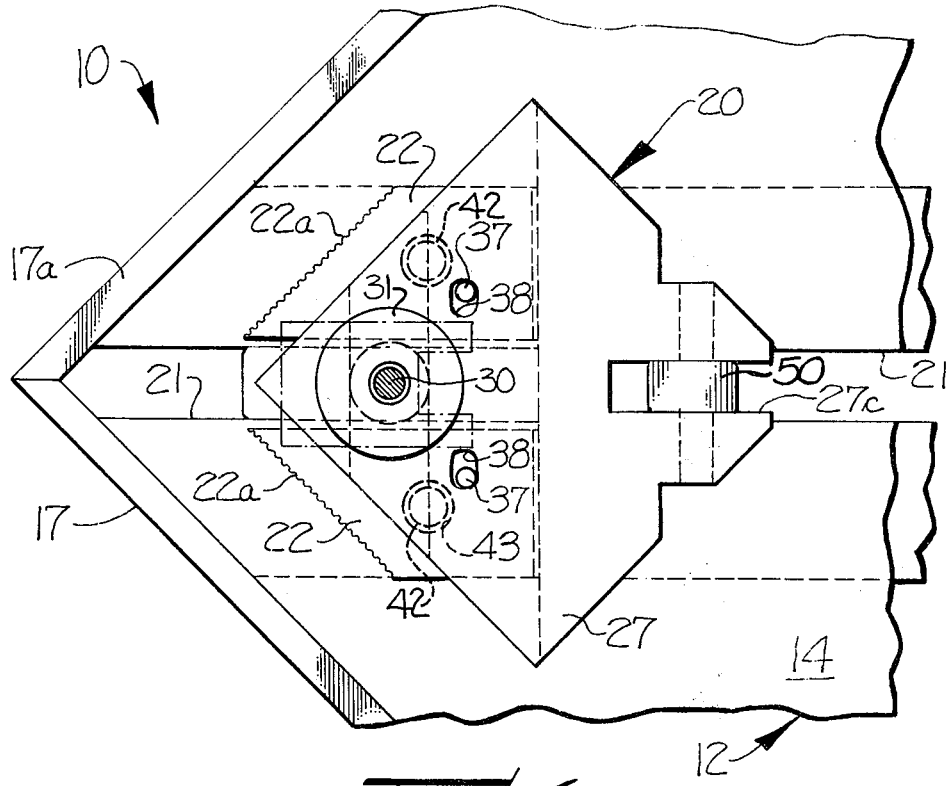
FIG. 6 is an enlarged, fragmentary, top, plan view, with the locking lever removed, of a portion of the apparatus shown in FIG. 4 and taken substantially at the arrow 6 of FIG. 4.
Figures 10, 11, 11A:
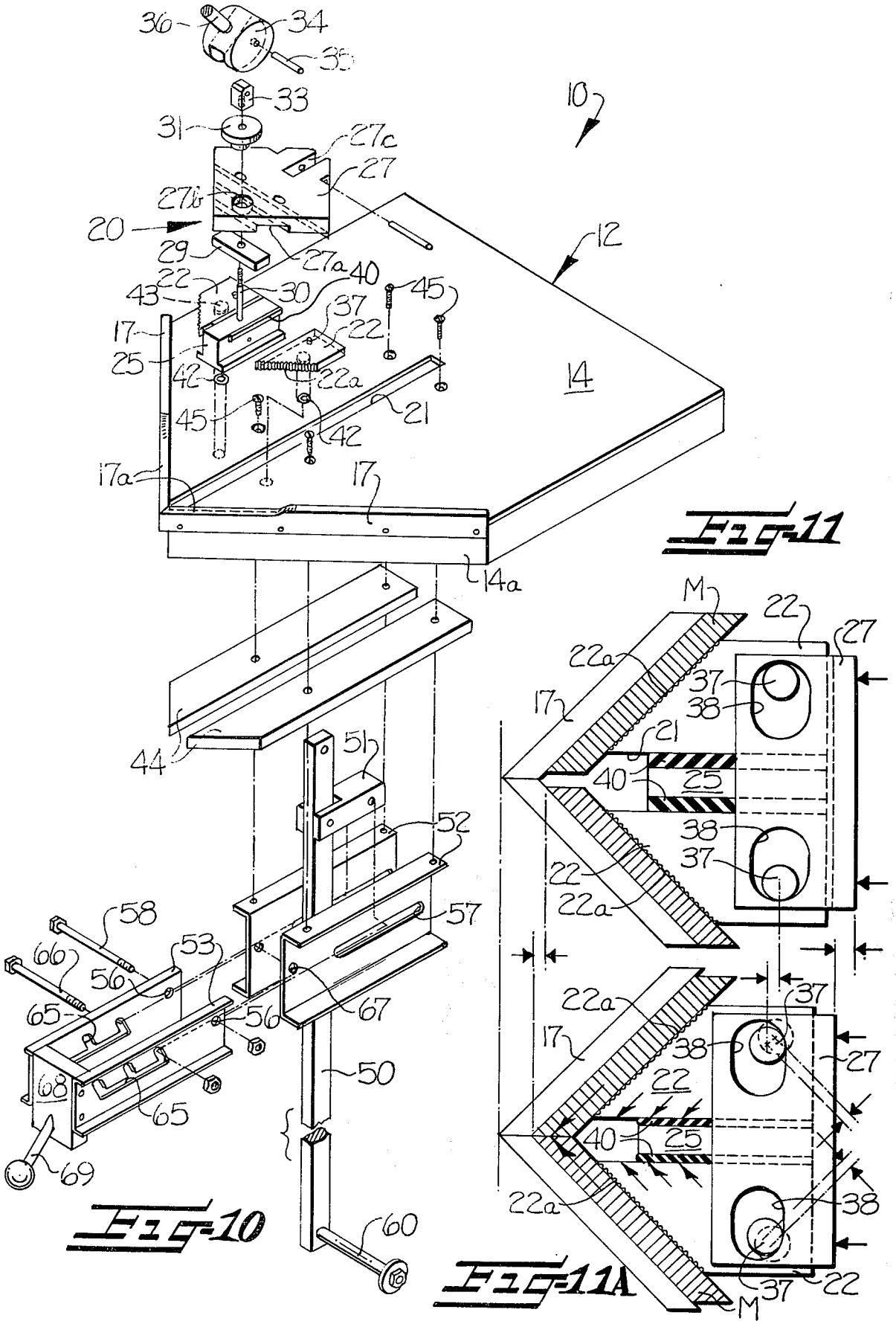
FIG. 10 is an exploded, perspective view of portions of the clamping apparatus of this invention.
FIGS. 11 and 11A are schematic views illustrating the composite sliding block member and gripper members of the clamping apparatus of this invention in their relative positions as they engage the workpieces in FIG. 11 and after they have applied positioning and clamping forces to the workpieces in FIG. 11A.

The gripper members 22 are separately biased and cushioned against the opposing transverse movements thereof toward each other and into positions in which the pins 37 are positioned in the outermost portions of the generally rounded slots 38, as shown in FIG. 6 and the upper portion of schematic FIG. 11. This biasing and cushioning is preferably accomplished by providing resilient, compressible, elongate elastomeric members 40, such as rubber, synthetic rubber or the like, between the inside longitudinal edges of the gripper members 22 and the center member 25 of the composite slide block 20.

Thus, as shown particularly in the schematic illustration of FIGS. 11 and 11A, the composite slide block 20 is moved forwardly in the slot 21 in the table top portion 14 of the work table means 12 for purposes of clamping and positioning the picture frame moldings M in desired, angularly related, tight, end-to-end, abutting relation for being secured together. During this forward movement, as the gripper members 22 by the serrated forward ends 22a thereof engage the inside longitudinal edges of the picture frame molding M, the moldings M will be pushed against the backstops 17 into tight engagement. Further forward movement of the composite sliding block 20, as indicated in the schematic illustration of FIG. 11A, will result in camming of the pins 35 carrying the gripper members 22 slightly forwardly and generally tranversely toward each other against the bias of elastomeric members 40 to effect a slightly forward and generally transverse movement of the gripper members 22 toward each other to effect clamping of the moldings M between the gripper members 22 and the backstops 17 while simultaneously effecting longitudinal sliding movements of the moldings M toward each other into a tight end-to-end abutting relation for positioning of the moldings M. The above described movements and distances are indicated by the comparision position lines and arrows in the schematic illutrations of FIGS. 11 and 11A.

The above arrangement of the elastomeric biasing members 40 and the camming action of the pin and slot arrangements 35, 36 for the gripper members 22 and the composite sliding block 20, will ensure a substantially even and equal application of these clamping and positioning forces by the gripper means regardless of slight variations in the widths of the moldings M since the elastomeric members 40 will be compressed at a rate depending upon the actual width of each of the moldings M.

Figure 8:
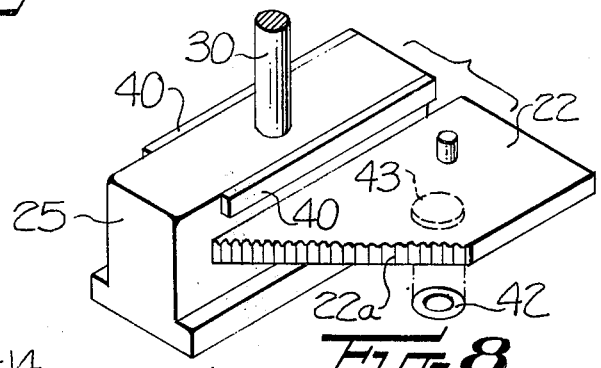
FIG. 8 is an enlarged perspective detail of a portion of the composite sliding block and one of the gripper devices of the apparatus of this invention.
Figure 9:
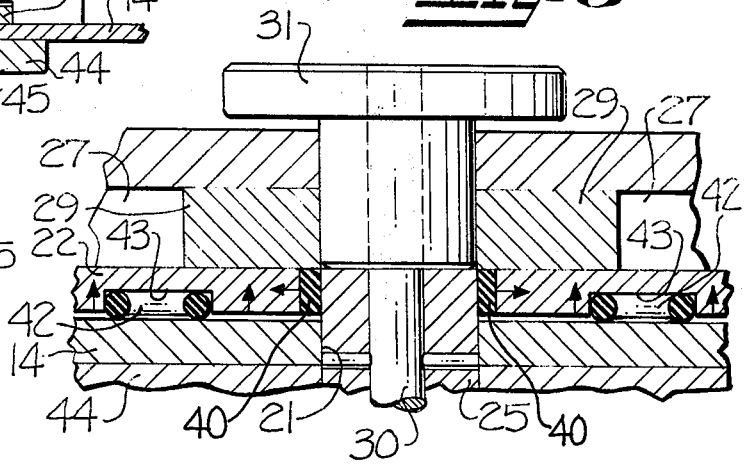
FIG. 9 is an enlarged, fragmentary, cross-sectional view illustrating a portion of the apparatus shown in FIG. 7.

The clamping apparatus 10 further includes means operatively connected with the composite sliding block 20 for releasably locking the sliding block 20 and the gripper members 22 in clamping engagement with the picture frame moldings M after the positioning and clamping forces have been applied thereto. For this purpose, the gripper members include resilient, compressible, members 42, which may be in the form of rubber O-rings, contained within circular cavities 43 in the bottom surface of each of the gripper members 22, as shown in FIGS. 8, 9 and 10 particularly. Also, elongate plate members 44 are secured to the bottom surface of the table top portion 14 by screws 45 so that the bottom portion of center member 25 of the composite sliding block 20 will slide along the bottom surfaces of plates 44. During sliding movement of the composite sliding block member 20 and gripper members 22, the members 42 will slide along the top surface of table top portion 14.

Figure 4:
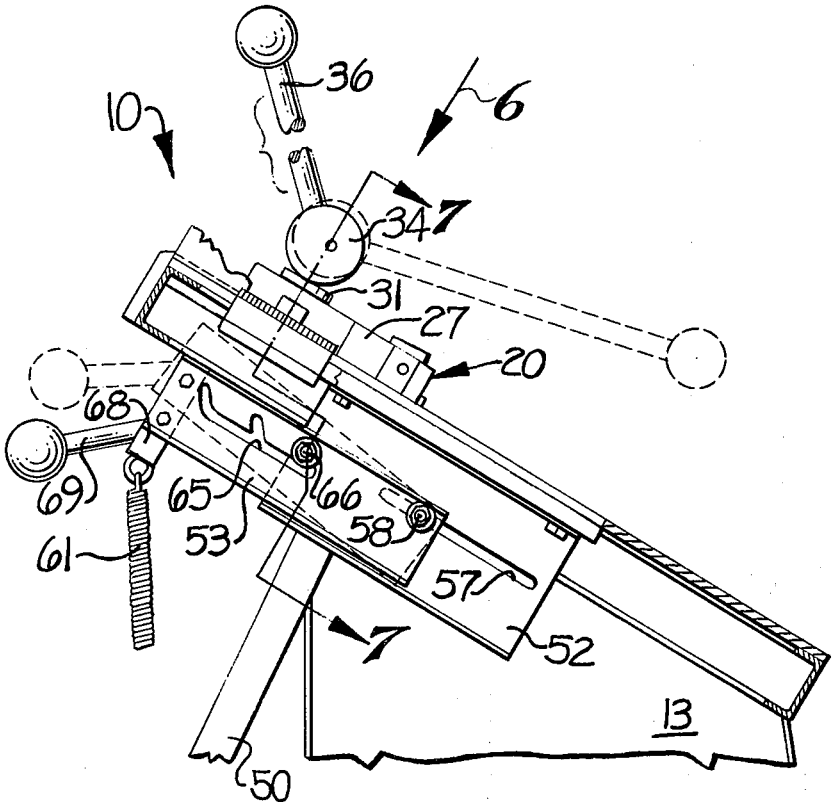
FIG. 4 is an enlarged, cross-sectional view, taken substantially along the line 4—4 of FIG. 3.

When the picture frame moldings M have been clamped and positioned by forward movement of the composite sliding block 20 and gripper members 22, as described above, the eccentric 34 will be rotated ftom the solid line position of FIG. 4 to the dotted line position thereof which will effect a locking action of the composite sliding block 20 by causing the locking palte 29 to push down on gripper members 22 by the downward movement of sleeve 31 onto the locking plate 29. This will cause compression of the resilient members 42 to cause the gripper members 22 to tightly engage the table top 14. Likewise, the bottom portion of the center member 25 will be pulled upwardly into tight engagement with the plates 44 to thereby tightly lock the sliding block 20 and the gripper members 22 in their clamping engagement with the moldings M for holding the moldings M tightly for being secured together by nails, screws or the like. This locking arrangement may be released simply by rotating the eccentric 34 by moving the handle 36 from the position shown in FIG. 1 to the solid line position of FIG. 4.

The compressible, resilient members 42 further function as means to elevate the gripper members 22 from the table top portion 14 for aiding in the sliding movement thereof toward the molding M along slot 21 and for further aiding in the independent transverse movements of the gripper members 22 toward each other by reducing frictional contact between the table top portion 14 and the gripper members 22.

Figure 5:
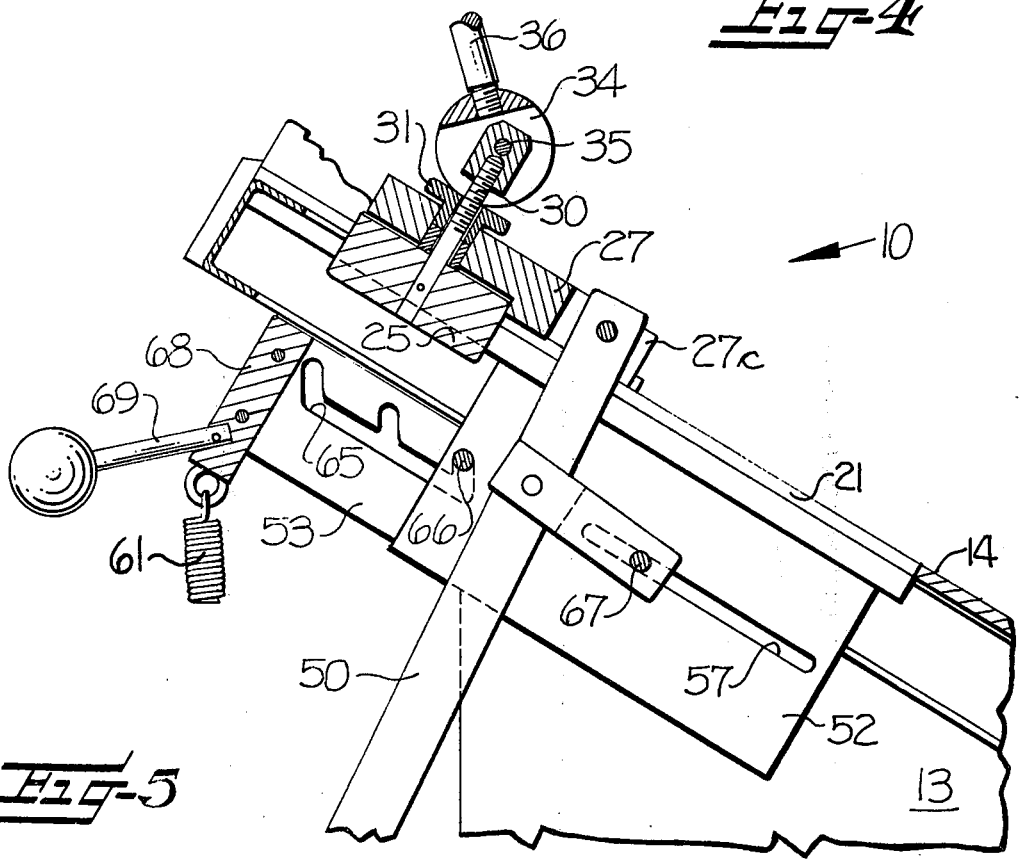
FIG. 5 is an enlarged, cross-sectional view, taken substantially along the line 5—5 of FIG. 3.

The clamping apparatus 20 further includes means operatively connected with the sliding block 20 for moving the composite sliding block 20 and the gripper members 22 along the slot 21 and into and out of clamping and positioning engagement with the picture frame moldings M. This means comprises a downwardly extending, elongate lever 50 which is pivotally mounted at its upper end by pin 51 to cut out 27c in the rear portion of the top cover member 27 of composite slide block 20, as shown particularly in FIGS. 5 and 10. The lever 50 is pivoted midway thereof to a block member 51 which is in turn mounted between telescoping sets of angled plates 52, 53. The angled plates 52 are secured to the bottom of the table top portion 14 and the plates 44 by the screw members 45. The other end of the block 51 is mounted by a pin 58 through apertures 56 in the plates 53 and elongate slots 57 in the plates 52. The path of travel of the slide block 20 along the slot 22 is restricted by the relative positions of the pin 58 the elongate slots 57 of the plates 52 so that the path of linear movement back and forth of the sliding block 20 within the slot 21 is restricted to a predetermined length less than the length of the slot 21.

The bottom end of lever 50 includes a foot engaging extension 60 and is biased forwardly by spring 61. For movement of the sliding block 20 and gripper members 22 forwardly into engagement with the moldings M, an operator would place his foot on the extension 60 of the lever 50 and push the lever rwardly against the bias of spring 61 so as to pivot the upper end of lever 50 forwardly moving the sliding block 120 and the gripper members 22 forwardly.

For varying the position of the restricted or predetermined linear path of travel back and forth of the sliding block 20 within the slot 21 of the table portion 14, the side plates 53 include generally saw tooth shaped elongate slots 65 having upwardly extending notches for the reception of a apin 66 therethough which also passes through apertures 67 in the side plates 52. The plates 53 are connected at their fprward ends by a partition 68 which includes an outwardly extending handle 69 and receives the other end of spring 61 to bias the plates 56 downwardly for maintaining the pin 66 in one of the notches of slot 65.

When the pin 66 is located in the rearward notch of slot 65, the restricted predetermined path of linear travel of the sliding block 20 is in its forwardmost position for clamping and positioning engagement with realtively narrow picture frame moldings M. If wider picture frame moldings are to be positioned and clamped by the apparatus 10 of this invention, the operator may manually pull down on handle 69 to move the bolt 66 into the longitudinally extending portion of slots 65 and then push the plates 53 rearwardly moving the pin 58 rearwardly in the slots 57 of the plates 52. This moves the entire lever mechanism 50 and composite sliding block 20 rearwardly within the slot 21. Thus, the apparatus 10 may be adjusted for various width picture frame moldings M.

It is clear from the above description and the illustration of the drawings that this invention has provided a clamping device or apparatus 10 for quickly and accurately positioning and maintaining a pair of longitudinally extending picture frame moldings M or other workpieces in desired, generally end-to-end, angularly related positions and which will evenly and resiliently apply clamping forces and positioning forces to the pair of picture frame moldings M for pushing the picture frame moldings M into tighter end-to-end abutting relation and for holding these picture frame moldings against fixed backstops for securing of the molding together at the corners regardless of any slight variations in width of the workpieces. This, thus constructed, apparatus 10 overcomes the problems presented with prior clamping devices for such purposes.

In the drawings and specification there has been set forth a preferred embodiment of this invention, and although specific terms are employed, they are used in a generic and descriptive sense only and not for purposes of limitation.

What is claimed is:

1. Clamping device for quickly and accurately positioning and maintaining a pair of workpieces in predetermined, generally end-to-end angularly related positions and being characterized by evenly and resiliently applying clamping forces and positioning forces to the pair of workpieces regardless of slight variations in width of the workpieces, said clamping device comprising backstop means having respective angularly related surface portions positioned for receiving the respective outside longitudinal side edges of the workpieces and for positioning the workpieces in predetermined angularly related positions with respect to one another defining a predetermined included angle therebetween.

slide block means located within the included angle formed by the workpieces when positioned against said backstop means and mounted for movement along a longitudinal axis toward and away from the workpieces and said backstop means, a pair of separate gripper means operatively connected to and carried by said slide block means in side-by-side transversely spaced relation to one another and having portions thereof facing toward said backstop means and defining workpiece engaging surfaces, said pair of gripper means being operatively connected to said slide block means for simultaneous movement with the slide block means longitudinally toward the workpieces and said backstop means for engaging the inside longitudinal edges of the respective workpieces and for clamping the workpieces against said backstop means, and also being operatively connected to said slide block means for allowing independent, generally transverse movement relative to one another, so that upon engagement of the gripper means with the respective inside edges of the workpieces the gripper means may move transversely toward one another for sliding the workpieces toward each other for a tight end-to-end abutment, and resilient means cooperating with each of said gripper means for biasing and cushioning the gripper means in opposition to transverse movement of the gripper means toward one another for thereby insuring substantially equal and even applications of the clamping and positioning forces by said gripper means to the respective workpieces regardless of slight variations in width thereof.

2. Clamping device, as set forth in claim 1, in which said clamping device further includes means operatively connected with said slide block means for moving said slide block and said gripper means into and out of clamping and positioning engagement with the workpieces.

3. Clamping device, as set forth in claim 1, in which said clamping device further includes means operatively connected with said slide block means for releasably locking said slide block means and said gripper means in clamping engagement with the workpieces.

4. Clamping device, as set forth in claim 1, in which the portions of said gripper means defining said workpiece engaging surfaces have roughened edges therealong for facilitating applying the clamping and positioning forces by said gripper means to the workpieces.

5. Clamping device, as set forth in claim 1, in which said gripper means are operatively connected to said slide block means by respective pin means secured to each of said gripper means and extending therefrom, with respective generally rounded slot means being formed in said slide block means and being of greater dimensions than said pin means and respectively receiving the pin means therein for carrying said gripper means with said slide block means and for allowing independent transverse movement of said gripper means toward and away from each other and relative to said slide block means by movement of said pin means within said slot means.

6. Clamping device, as set forth in claim 5, in which said slide block means comprises a generally flat, composite block member including a solid medial portion and spaced-apart voids on each side of said medial portion for receiving said gripper means, said gripper means each comprises a generally flat gripper member positioned respectively within one of the voids in said block member and having portions extending beyond said block member to define said workpiece engaging surface, and said resilient means comprises respective resilient elastomeric members positioned between opposing surfaces of said generally flat gripper members and the solid medial portion of said block member for biasing said gripper members away from the medial portion of said block member and allowing compression of said elastomeric members during movements of each of said gripper members relative to said block member for cushioning the movements.

7. Clamping device for quickly and accurately positioning and maintaining a pair of workpieces in predetermined, generally end-to-end angularly related positions and being characterized by evenly and resiliently applying clamping forces and positioning forces to the pair of workpieces regardless of slight variations in width of the workpieces, said clamping device comprising backstop means having respective angularly related surface portions positioned for receiving the respective outside longitudinal side edges of the workpieces and for potitioning the workpieces in predetermined angularly related positions with respect to one another defining a predetermined included angle therebetween, slide block means mounted for longitudinal movement toward and away from the workpieces and said backstop means along an axis bisecting the included angle formed by the workpieces when positioned against said backstop means, said slide block means having a solid medial portion and transversely spaced-apart voids therein on each side of the solid medial portion, a pair of gripper members positioned respectively within the transversely spaced-apart voids of said slide block means, said gripper members each having portions thereof extending outwardly beyond said slide block means and facing toward said backstop means and defining respective workpiece engaging surfaces, means operatively connecting said pair of gripper members to said slide block means for simultaneous longitudinal movement with said slide block means for engaging the inside longitudinal edges of the respective workpieces and for clamping the workpieces against said backstop means, and said means operatively connecting said pair of gripper members to said slide block means also allowing independent generally transverse movement of the gripper members relative to one another so that upon engagement of the gripper members with the respective inside edges of the workpieces, the gripper members may move transversely toward one another for sliding the workpieces toward each other for a tight end-to-end abutment, said means operatively connecting said pair of gripper members to said slide block means comprising respective pin means secured to each of said gripper members and extending therefrom, and respective generally rounded slot means formed in said slide block means and being of greater dimensions than said pin means and respectively receiving the pin means therein, resilient elastomeric members positioned between opposing surfaces of said gripper members and the solid medial portion of said slide block means and cooperating with said gripper members for biasing the same away from the medial portion of said slide block means in opposition to transverse movement for the gripper members toward one another for thereby insuring substantially equal and even application of the clamping and positioning forces by said gripper members to the respective workpieces regardless of slight variations in width thereof.

means operatively connected with said slide block means for moving the same and said gripper members into and out of clamping engagement with the workpieces, and means operatively connected with said slide block member for releasably locking the same and said gripper members in clamping engagement with the workpieces.

8. Clamping apparatus for quickly and accurately positioning and maintaining a pair of mitered end picture frame moldings in desired end-to-end angularly related positions for being fastened together to form picture frames and being characterized by evenly and resiliently applying clamping forces and positioning forces to the pair of picture frame moldings regardless of slight variations in width of the moldings, said apparatus comprising work table means for receiving the bottom surfaces of the mitered end picture frame moldings to be secured together in end-to-end angularly related relationship, backstop means carried by said work table means and having respective angularly related surface portions positioned for receiving the outside longitudinal side edge of each of the picture frame moldings and for positioning the picture frame moldings in predetermined angularly related positions with respect to one another defining a predetermined included angle therebetween, slide block means mounted on said work table means within the included angle formed by the picture frame moldings when positioned against said backstop means and positioned for movement along a longitudinal axis bisecting the included angle and toward and away from the inside longitudinal side edges of the moldings, a pair of gripper means operatively connected to and carried by said slide block means in side-by-side transversely spaced relation to one another and extending forwardly of said slide block means facing toward said backstop means and defining respective workpiece engaging surfaces, said pair of gripper means being operatively connected to said slide block means for simultaneous movement with the slide block means longitudinally toward the picture frame moldings and said backstop means for engaging the inside longitudinal edges of the respective moldings and for clamping the moldings against said backstop means, and said pair of gripper means also being operatively connected to said slide block means for allowing independent, generally transverse movement relative to one another, so that upon engagement of the gripper means with the respective inside edges of the moldings the gripper means may move transversely toward one another for sliding the moldings toward each other for a tight end-to-end abutment, and resilient means cooperating with each of said gripper means for biasing and cushioning the gripper means in opposition to transverse movement of the gripper means toward one another for thereby insuring substantially equal and even application of the clamping and positioning forces by said gripper means to the respective workpieces regardless of slight variations in width thereof.

9. Clamping apparatus, as set forth in claim 8, in which said work table means comprises a generally vertically extending base portion for supporting said apparatus at a convenient working height from a floor, a table top portion carried by said base portion and positioned at an upwardly extending angle with respect to the horizontal for providing an upwardly extending upper surface for receiving and supporting the picture frame moldings, the upper side edges of said table top portion being disposed at an approximately ninety degree angle with respect to each other for mounting said backstop means along said edges to be positioned in the fixed angularly related positions of approximately ninety degrees with respect to each other for positioning and clamping the picture frame moldings at the same angular relation, and extension means extending from the lower edges of said table top portion for supporting the rearwardly extending portions of long picture frame moldings.

10. Clamping apparatus, as set forth in claim 9, in which the angularly related surface portions of said backstop means comprise respective flange members extending upwardly from and along said angularly related, upper, side edges of said table top portion and including cut outs in the sections thereof adjacent the vertex of the angle formed thereby for allowing access to the abutting ends of the picture frame moldings positioned thereagainst for securing the moldings together.

11. Clamping apparatus, as set forth in claim 9, in which said table top portion defines a slot extending therethrough along an axis bisecting the included angle formed by the picture frame moldings when positioned against said backstop means for receiving said slide block means and allowing the linear movement thereof along said slot, and said apparatus further includes lever means operatively connected with said slide block means and extending downwardly from said table top portion of said work table means for manual foot engagement by an operator for moving said slide block and said gripper means into and out of clamping and positioning engagement with the picture frame moldings.

12. Clamping apparatus, as set forth in claim 11, in which said apparatus further includes adjustable means operatively connected with said foot lever means for limiting the length of the path of linear movement of said slide block means within said table top slot and for adjusting forwardly and backwardly such path of linear movement to compensate for various width picture frame moldings.

13. Clamping apparatus, as set forth in claim 11, in which said clamping apparatus further includes eccentric, manually operated means operatively connected with said slide block means for releasably locking said slide block means and said gripper means in clamping engagement with the picture frame moldings and against said table top portion of said work table means.

14. Clamping apparatus, as set forth in claim 8, in which said apparatus further includes means operatively associated with said work table means and each of said gripper means for elevating said gripper means above said work table means for aiding in the linear and transverse movements of said gripper means along said work table means by reducing frictional contact therebetween.

15. Clamping apparatus, as set forth in claim 14, in which said elevating means comprises cavities formed in the bottom surfaces of said gripper members, and resilient, compressible members positioned in said cavities slide block means located within the included angle formed by the workpieces when positioned against said backstop means and mounted for movement along a longitudinal axis toward and away from the workpieces and said backstop means, a pair of separate gripper means operatively connected to and carried by said slide block means in side-by-side transversely spaced relation to one another and having portions thereof facing toward said backstop means and defining workpiece engaging surfaces, said pair of gripper means being operatively connected to said slide block means for simultaneous movement with the slide block means longitudinally toward the workpieces and said backstop means for engaging the inside longitudinal edges of the respective workpieces and for clamping the workpieces against said backstop means, and also being operatively connected to said slide block means for allowing independent, generally transverse movement relative to one another, so that upon engagement of the gripper means with the repsective inside edges of the workpieces the gripper means may move tranversely toward one another for sliding the workpieces toward each other for a tight end-to-end abutment, and resilient means cooperating with each of said gripper means for biasing and cushioning the gripper means in opposition to transverse movement of the gripper means toward one another for thereby insuring substantially equal and even applications of the clamping and positioning forces by said gripper means to the respective workpieces regardless of slight variations in width thereof.

* * * * *

UNITED STATES PATENT AND TRADEMARK OFFICE

CERTIFICATE OF CORRECTION

PATENT NO. : 3,944,200

DATED : March 16, 1976

INVENTOR(S) : James R. Huntley

It is certified that error appears in the above-identified patent and that said Letters Patent are hereby corrected as shown below:

Column 1, Line 7, change "an" to --and--; Line 8, change "a" to --as--, Line 51, change "or" to --of--.
Column 3, Line 32, change "degress" to --degrees--.
Column 6, Line 51, change "ftom" to --from--; Line 54, change "palte" to --plate--.
Column 7, Line 29, after "58" and before "the" insert --within--; Line 39, change "rwardly" to --rearwardly--; Line 41, change "120" to --20--; Line 48, change "apin" to --pin--; Line 50, change "fprward" to --forward--.
Column 9, Line 65, CLAIM 7, change "potitioning" to --positioning--.
Column 10, Line 45, CLAIM 7, change first occurrence of "for" to --of--.
Column 12, Line 58, CLAIM 15, after "cavities" insert a period --.-- and delete the remainder of the claim appearing in Columns 12, 13 and 14.

Signed and Sealed this

*first* Day of *June 1976*

[SEAL]

*Attest:*

RUTH C. MASON
*Attesting Officer*

C. MARSHALL DANN
*Commissioner of Patents and Trademarks*